United States Patent [19]

Ray

[11] 4,374,761

[45] Feb. 22, 1983

[54] INERT ELECTRODE FORMULATIONS

[75] Inventor: Siba P. Ray, Plum Boro, Pa.

[73] Assignee: Aluminum Company of America, Pittsburgh, Pa.

[21] Appl. No.: 205,653

[22] Filed: Nov. 10, 1980

[51] Int. Cl.[3] ..... H01B 1/06

[52] U.S. Cl. ..... 252/519; 252/512; 252/513; 252/514; 252/518; 252/520; 204/67

[58] Field of Search ..... 252/512, 513, 514, 518, 252/519, 520, 521; 204/67

[56] References Cited

U.S. PATENT DOCUMENTS

| | | | |
|---|---|---|---|
| 3,930,967 | 1/1976 | Alder | 204/67 |
| 3,960,678 | 6/1976 | Alder | 204/67 |
| 3,962,068 | 6/1976 | Zollner et al. | 204/290 F |
| 3,974,046 | 8/1976 | Alder | 204/67 |
| 4,039,401 | 8/1977 | Yamada et al. | 204/67 |
| 4,146,438 | 3/1979 | DeNora et al. | 204/1.5 |
| 4,173,518 | 11/1979 | Yamada et al. | 204/67 |
| 4,187,155 | 2/1980 | DeNora et al. | 204/67 |

FOREIGN PATENT DOCUMENTS

| | | |
|---|---|---|
| 52-14041 | 11/1977 | Japan . |
| 1295117 | 11/1972 | United Kingdom . |

*Primary Examiner*—J. L. Barr

*Attorney, Agent, or Firm*—Andrew Alexander

[57] ABSTRACT

Disclosed is an inert electrode composition suitable for use in the electrolytic production of metal from a metal compound dissolved in a molten salt. The electrode comprises a ceramic oxide composition and at least one metal powder dispersed through the ceramic oxide composition for purposes of increasing its conductivity, the metal powder selected from the group consisting of Ni, Cu, Co, Pt, Rh, In and Ir.

7 Claims, 4 Drawing Figures

INERT ELECTRODE FORMULATIONS

INTRODUCTION

This invention relates to the electrolytic production of metals such as aluminum, lead, magnesium, zinc, zirconium, titanium, silicon and the like, and more particularly it relates to an inert type electrode for use in the production of such metals.

When aluminum, for example, is produced by electrolysis of alumina dissolved in molten salt using carbon electrodes, carbon dioxide is produced at the anode as a result of the oxygen liberated on the decomposition of the alumina. That is, the oxygen liberated reacts and consumes the carbon anode. Thus, about 0.33 pounds of carbon must be used for every pound of aluminum produced. Carbon such as that obtained from petroleum coke is normally used for such electrodes. However, because of the increasing cost of such cokes, it has become necessary to find a new material for the electrodes. A desirable new material would be one which would not be consumed and would be resistant to attack by the molten bath. In addition, the new material should be capable of providing a high current efficiency, should not affect the purity of metal and should be resonable with respect to the cost of raw material and with respect to fabrication.

Numerous efforts have been made to provide an inert electrode of the type referred to but apparently without the required degree of success to make it economically feasible. That is, the inert electrodes in the art appear to be reactive to an extent which results in contamination of the metal being produced as well as consumption of the electrode. For example, U.S. Pat. No. 4,039,401 reports that extensive investigations were made to find nonconsumable electrodes for molten salt electrolysis of aluminum oxide and that spinel structure oxides or perovskite structure oxides have excellent electronic conductivity at a temperature of 900° to 1000° C., exhibit catalytic action for generation of oxygen and exhibit chemical resistance. Also, in U.S. Pat. No. 3,960,678 there is disclosed a process for operating a cell for the electrolysis of aluminum oxide with one or more anodes, the working surface of which is of ceramic oxide material. However, according to the patent, the process requires a current density above a minimum value to be maintained over the whole anode surface which comes in contact with the molten electrolyte to minimize the corrosion of the anode. Thus, it can be seen that there is a great need for an electrode which is substantially inert or is resistant to attack by molten salts or molten metal to avoid contamination and its attendant problems.

The present invention provides an electrode which is highly resistant to attack by materials in an electrolytic cell and is relatively inexpensive to fabricate.

SUMMARY OF THE INVENTION

An object of the present invention is to provide an electrode composition which is resistant to molten salts.

Another object of the present invention is to provide an electrode which is resistant to molten salts in an electrolytic cell for the production of aluminum.

A further object of the present invention is to provide a process for the electrolytic production of metal, such as aluminum, using an electrode which is resistant to attack by molten salt.

These and other objects will be apparent from the drawings, specification and claims appended hereto.

In accordance with these objects there is provided an inert electrode composition suitable for use in the electrolytic production of metal from a metal compound dissolved in a molten salt. The electrode comprises a ceramic oxide composition and at least one metal powder dispersed through the ceramic oxide composition for purposes of increasing its conductivity, the metal powder selected from the group consisting of Ni, Cu, Co, Pt, Rh, In and Ir.

DETAILED DESCRIPTION OF THE INVENTION

Figure 1:
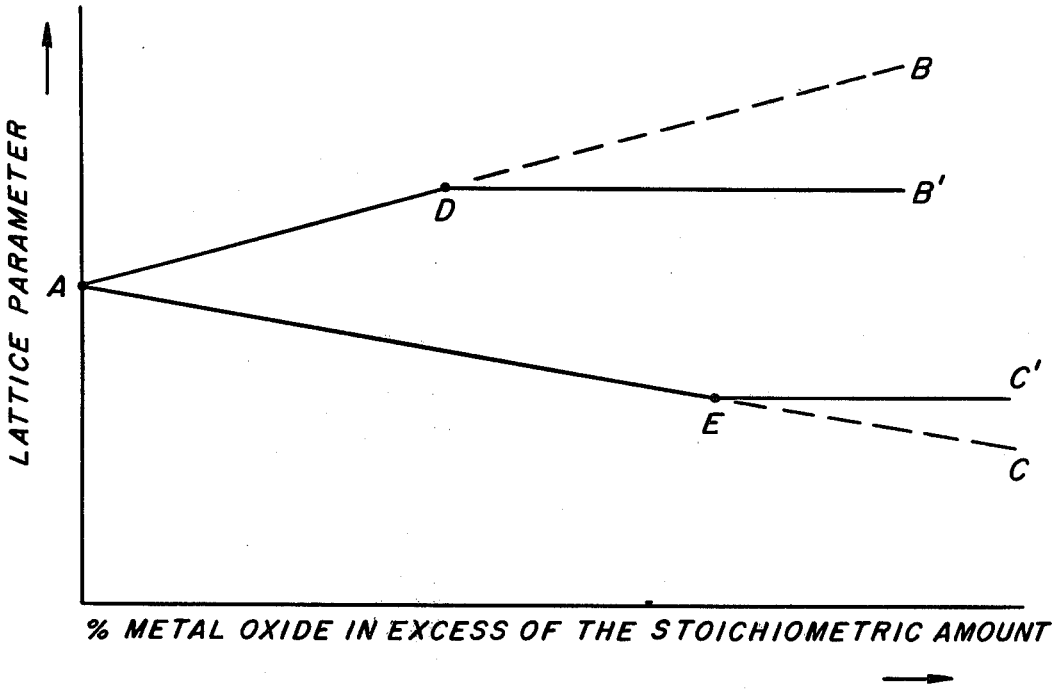
FIG. 1 is a graph illustrating or exemplifying the change in lattice parameter versus percent metal oxide in excess of the stoichiometric amount.

An inert electrode suitable for use for the production of aluminum, for example, must meet certain criteria. For example, the electrode must have a high level of conductivity. Further, it must be resistant to attack by the bath. In addition, it should have a high resistance to oxidation. Other considerations include cost and ease of fabrication. That is, the cost must be such as to make the electrode economically feasible. All of these areas are important. For instance, if the electrode is not resistant to attack, then the metal, e.g. aluminum, produced can be contaminated. Or, if conductivity is too low, then the cost, in terms of energy, becomes too high. Thus, it can be seen that these factors are very important in order to have a completely satisfactory electrode.

Accordingly, it has been discovered that when the electrode is fabricated from metal oxides, nitrides, borides, sulfides, carbides or halides or combinations thereof, it will meet these requirements only if the oxides or the other materials are carefully selected and combined so as to provide a combination having a specific formulation. That is, it has been found that without the careful selection of the components and the combination thereof in controlled amounts, the electrode will not have satisfactory resistance to attack by bath.

Thus, in accordance with the present invention, an electrode composition is fabricated from at least two metals or metal compounds combined to provide a combination metal compound containing at least one of the group consisting of oxide, fluoride, nitride, sulfide, carbide or boride, the combination metal compound defined by the formula:

$$\left\{\sum_{i=1}^{m} (M_i)F_{Mi}\right\}\left\{\sum_{j=1}^{p} (M_j)F_{Mj}\sum_{i=1}^{m} (M_i)F_{Mi}\right\}_Z\left(\sum_{r=1}^{n} X_rF_{xr}\right)_K$$

where $$\sum_{i=1}^{m} F_{Mi} = 1;\ \sum_{j=1}^{p} F_{Mj} + \sum_{i=1}^{m} F_{Mi} = 1 \text{ and } \sum_{r=1}^{n} X_rF_{xr} = 1;$$

Z is a number in the range of 1.0 to 2.2; K is a number in the range of 2.0 to 4.4; $M_i$ is at least one metal having a valence of 1, 2, 3, 4 or 5 and is the same metal or metals whenever $M_i$ is used in the composition; $M_j$ is a metal having a valence of 2, 3 or 4; $X_r$ is at least one of the elements from the group consisting of O, F, N, S, C and B; m, p and n refer to the number of components which can comprise $M_i$, $M_j$ and $X_r$; $F_{Mi}$, $F'_{Mj}$, $F'_{Mi}$ or $F_{xr}$ are the mole fractions of $M_i$, $M_j$ and $X_r$ and $0 \leqq F'_{Mi} < 1$ except where $M_i$ is Sn, Ti or Zr or when m=1, or when $X_r$ is oxygen and K is 3, in which cases $0 < \Sigma F'_{Mi} < 1$.

When $M_i$ is selected from nickel and cobalt, $M_j$ is iron and $X_r$ is oxygen, a typical compound would be $(Ni_{0.5}Co_{0.5})(Fe_{0.6}Ni_{0.2}Co_{0.2})_2O_4$. If $M_i$ also includes zirconium in addition to the above then a typical compound can be $(Ni_{0.4}Co_{0.2}Zr_{0.4})(Fe_{0.6}Ni_{0.2}Co_{0.2})_2O_4$. Or if tin is substituted for zirconium, a typical compound would be $(Ni_{0.4}Co_{0.2}Sn_{0.4})(Fe_{0.6}Ni_{0.2}Co_{0.2})_2O_4$. As noted earlier, it is also within the purview of the invention to use elements in substitution for or in addition to oxygen. For example, if $M_i$ and $M_j$ are nickel and iron, respectively, then fluorine may be added in addition to oxygen for example to provide a metal oxyfluoride such as $Ni(Fe_{0.6}Ni_{0.4})_2O_3F$. It should be noted that other metals may be used and other elements may be used to provide metal oxysulfides, oxynitrides, oxycarbides and oxyborides and the like, all of which are considered to be within the scope of the present invention. The following list is typical of combination compounds in accordance with the invention, the compounds having metals at least two of which must be used in such combination compounds: $Ni(Fe_{0.6}Ni_{0.4})_2O_4$; $Ni(Fe_{0.6}Ni_{0.4})O_3F$; $NiLiF_4$; $V(Mn_{0.8}V_{0.2})O_4$; $Ni(Ni_{0.05}Co_{0.95})_2O_4$; $(Co_{0.9}Fe_{0.1})(Fe_2)O_4$; $(Sn_{0.8}V_{0.2})Co_2O_4$; $Co(Co_{0.05}Fe_{0.95})_2O_4$; $(Co_{0.9}Fe_{0.1})Fe_2O_4$; $(Ni_{0.5}Co_{0.4}Fe_{0.1})Fe_2O_4$; $(Ni_{0.6}Nb_{0.4})(Fe_{0.6}Ni_{0.4})_2O_4$; $(Ni_{0.8}Nb_{0.2})(Fe_{0.6}Co_{0.4})_2O_4$; $(Ni_{0.6}Ta_{0.4})(Fe_{0.6}Co_{0.4})_2O_4$; $(Ni_{0.6}Co_{0.2}Zr_{0.2})(Fe_{0.8}Co_{0.2})_2O_4$; $(Ni_{0.6}Hf_{0.4})(Fe_{0.6}Ni_{0.4})_2O_4$; $(Ni_{0.4}Co_{0.2}Hf_{0.4})(Fe_{0.6}Co_{0.4})_2O_4$; $(Ni_{0.4}Co_{0.2}Zr_{0.4})(Fe_{0.6}Co_{0.4})_2O_4$; $(Ni_{0.6}Co_{0.1}Sn_{0.3})(Fe_{0.7}Co_{0.3})_2O_4$; $(Ni_{0.6}Li_{0.1}Zr_{0.3})(Fe_{0.7}Ni_{0.3})_2O_4$; $NiLi_2F_4$; $(Ni_{0.7}Co_{0.3})Li_2F_4$; $(Ge_{0.6}Ni_{0.4})(Fe_{0.6}Ni_{0.4})_2O_4$; $(Ge_{0.6}Co_{0.4})(Fe_{0.6}Co_{0.4})_2O_4$; $(Ni_{0.9}Cu_{0.1})(Fe_{0.6}Ni_{0.4})_2O_4$; $(Ni_{0.6}Zr_{0.2}Nb_{0.2})(Fe_{0.7}Ni_{0.3})_2O_4$; and $(Co_{0.6}Zr_{0.4})(Fe_{0.7}Zn_{0.3})_2O_4$.

It should be noted that certain of the compounds can have more inertness than others towards molten metal salts and are thus preferred. In addition, it should be understood that only those combination metal compounds having at least a reasonable degree of inertness with respect to molten salts are of interest with respect to their use for inert electrodes. That is, compounds clearly not having a suitable level of inertness with respect to molten salt are not considered to be within the purview of the invention.

In another aspect of the present invention, at least two metals or metal compounds, such as metal oxides, may be combined to provide or contain a combination metal oxide having the formula $M(M'_yM_{1-y})_zO_K$. That is, after selection of the components including metals or metal oxides they are combined in proportions which will result in a composition having this formula. For purposes of the present invention, y must be a number less than one and greater than zero. It is an important aspect of this invention that these limits be strictly adhered to. That is, it is important that y be less than one. It has been discovered that metal oxide composition obtained when y was equal to one resulted in an electrode composition which, while having some resistance to attack by a molten bath such as is used in making aluminum, had generally an unacceptable level of resistance. Compositions formulated where y was equal to one were attacked by the bath, e.g. cryolite with alumina dissolved therein, which, of course, results in an unacceptable contamination level of the metal being produced and the need for purification thereof as well as making it necessary to replace the electrode frequently. For example, U.S. Pat. No. 3,960,678 discloses that anodes comprised of $Fe_2O_3$ and $SnO_2$, or NiO, or ZnO resulted in high levels of impurity, e.g. Sn 0.80%, Fe 1.27%, Ni 0.45%, Fe 1.20%, Zn 2.01%, Fe 2.01%, and thus such materials were considered to be unsuitable for anodes because of the impurity problem and because the anodes were consumed. Thus, it can be seen that such or similar compositions must be avoided. In the subject formula, when y is equal to zero, it also will be seen that a suitable electrode composition is not obtained. Thus, in a preferred aspect of the invention, the value of y should be controlled so as to be a number in the range of about 0.1 to 0.9 with a suitable range being about 0.3 to 0.7, particularly when the valence of M is selected from the group consisting of 1, 2, 4 or 5 and M' is 3. If M is comprised of only two metals, then it must also include two metals throughout the formula. It should be understood that M may consist of three or more metals; however, in such instances, M does not have to comprise all such metals throughout the formula.

The value of z should be a number in the range of 1.0 to 2.2. Also, the value of K should be a number in the range of 2 to 4.4 with a typical value being in the range of 3 to 4.1. That is, for purposes of the present invention, M and M' are formulated into the electrode composition in nonstoichiometric amounts in accordance with the principles of the invention.

For purposes of the present invention, M is a metal having a valence selected from the group consisting of 1, 2, 3, 4 and 5 and M' is a metal having a valence selected from the group consisting of 2, 3, 4 and 5. Normally, in the present invention, M and M' are different metals, combinations of which are set forth hereinbelow for illustration purposes.

While in the electrode composition defined by the formula $M(M'_yM_{1-y})_zO_K$ reference has been made mainly to oxides of such compounds, the oxygen component can be replaced or substituted or partially substituted by fluorine, nitrogen, sulfur, carbon or boron. Accordingly, for convenience, the composition may be defined by the formula $M(M'_yM_{1-y})_zX_K$ where X can be at least one of the components, including oxygen, referred to immediately above.

It is within the purview of the invention to derive the electrode composition from metals as well as metal oxides. That is, metals are contemplated as a source of material which will result in the composition of the instant invention. For example, M and M' can be metals suitable for forming into an alloy, the proportions of which when subjected to oxidation would provide at least at the surface a layer containing or comprising a composition defined by the formula $M(M'_yM_{1-y})_zO_K$, for example. It will be understood that additional alloying elements may be provided in the alloy for purposes of modifying the characteristics of the resulting oxide. Additional elements may be added for purposes of changing the electrical conductivity or the resistance of the resulting oxide to attack by bath, e.g. molten salt.

FIG. 1 illustrates the effect which can be obtained whenever two metal oxides are combined to provide an electrode composition in accordance with the present invention. That is, in order to obtain the compositions suitable for electrodes of the invention, it is necessary, when using two metal oxides, to have one of the oxides in excess of the stoichiometric amount. In contrast, when two metal oxides such as ZnO and $Fe_2O_3$ are used, the normal stoichiometric equation is as follows:

$$Fe_2O_3+ZnO \rightarrow ZnFe_2O_4$$

and the resulting compound is considered to be stoichiometrically balanced. In such equation, the compound formed has a formula which is referred to as a spinel and which, while exhibiting some resistance to bath, e.g. molten salts, does not exhibit an inertness which is satisfactory, as can be seen from U.S. Pat. No. 3,960,678. Consequently, the dissolution and the corrosion of an electrode made from such material results in contamination of the metal produced and frequent replacement of the electrode which is economically unsatisfactory, as noted earlier. Because of the problems with stoichiometric spinels containing two metal oxides, it can be seen that they are best avoided. In the present invention, compositions having the formula $M(M'_yM_{1-y})_zO_K$ have demonstrated superior inertness to molten salts when compared to such spinels. As noted above, composition in accordance with the invention can be obtained, in the case of metal oxides, by providing one of the oxides in excess, as shown in FIG. 1. In the case of an NiO and $Fe_2O_3$ system, the NiO or the $Fe_2O_3$ may be kept in excess. In a preferred embodiment, the components are mixed in accordance with the formula to provide a composition which has one of the components in excess up to the maximum solid solution solubility limit, which is represented by points D or E, FIG. 1.

While the inventor does not necessarily wish to be bound by any theory of invention, it is believed that the effect of maintaining one of the metal oxides in excess results in the metal atoms in excess displacing the other metal atoms in the lattice structure. If metal atoms in excess are smaller than the other metal atoms, the result is a decrease in the distance between atoms in the structure and hence the decrease in the lattice parameter, as illustrated by the line A—E in FIG. 1. It will be understood that in different systems the effect may be to increase the lattice parameter by using an excess of one of the oxides. This effect would be obtained if the size of the metal atom in excess was greater than the other atom. An increase of lattice distance is illustrated by the line A—D of FIG. 1. It should be understood that point A in FIG. 1 shows where stoichiometrically balanced compositions, e.g. spinels or perovskite type structures, are located.

In addition to the above, it is believed that only a certain amount of substitution of one atom for another can take place to provide a composition in accordance with the invention. This point is indicated in FIG. 1 at points D or E, depending on which metal or metal oxide is provided in excess of the stoichiometric amount. The dotted line from D or E to B or C indicates the change in lattice distance, if substitution continued without interruption. When further substitution does not take place, then there is substantially no change in the lattice distance, as illustrated by lines D—B' or E—C'.

Figure 3:
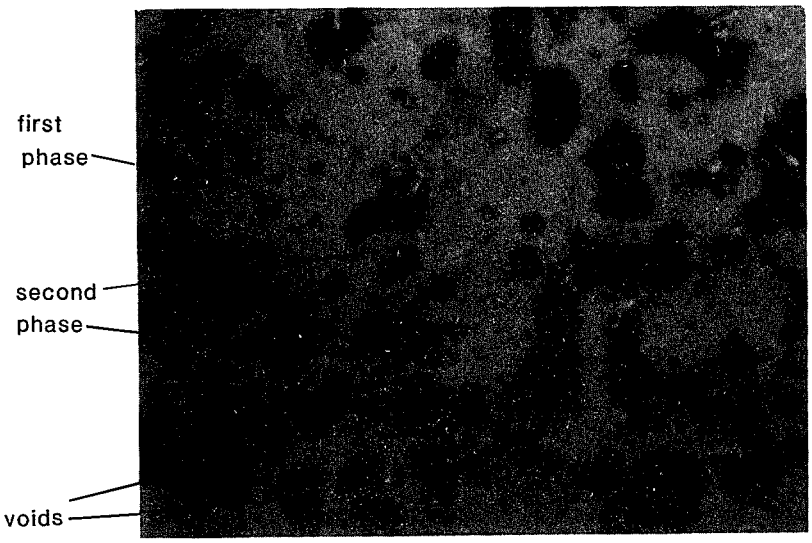
FIG. 3 is a micrograph showing an electrode composition in accordance with the invention.

It can be seen from FIG. 1 that lines A—D or A—E represent a composition in accordance with the invention. It will be noted that lines D—B' or E—C' represent an additional material, such as metal oxide, which can be present in the composition. Thus, another aspect of the invention contemplates a formulation having a first portion or phase having the formula $M(M'_yM_{1-y})_zO_K$ as defined hereinabove and second portion or phase being a material comprised substantially of a metal oxide, for example as shown in FIG. 3. Preferably, in this aspect of the invention the components are mixed in accordance with the formula to provide a composition which has one of the components in excess of the maximum solid solution solubility limit. By reference to FIG. 1, it will be seen that such limit is represented by point D or E. In addition, FIG. 3 illustrates a composition in accordance with the formula wherein one of the components has been provided in excess of the maximum solid solubility limit. When metal oxides are used to provide the electrode material and the amount of metal oxide used is in excess of that needed for substitution or in excess of the maximum solid solubility limit, the combination can be represented by the formula $M(M'_yM_{1-y})_zO_K+MO$, where the letters in the formula are as defined hereinabove and MO represents the second phase. When the electrode formulation is fabricated from two metal oxides, it is preferred that the second phase comprise at least the metal oxide in excess.

FIG. 3 is a micrograph at 400× of an electrode composition in accordance with the invention. From an examination of FIG. 3 it will be seen that there are different phases present. A phase referred to as a first phase has a composition in accordance with the formula of the invention. That is, in the micrograph the first phase, denoted or shown as areas which are substantially gray, has a composition defined by the formula $M(M'_yM_{1-y})_zO_K$. The second phase, shown as dark gray areas, represents the material in excess of that where substitution can be accommodated in the lattice structure. That is, the dark areas of the second phase are represented by the line D—B' or E—C' of FIG. 1. The darkest areas in the micrograph represent voids in the composition. The composition shown in FIG. 3 was formulated from NiO and $Fe_2O_3$ wherein 51.7 wt.% NiO was mixed with 48.3 wt.% $Fe_2O_3$ to provide a composition consisting essentially of $Ni(Fe_{0.7}Ni_{0.3})_2O_4$, the NiO being approximately 20 wt.% in excess of the stoichiometric amount.

The formulations referred to are important embodiments of the invention. That is, the formulations referred to are important in that if a second phase is present, then it should be chosen carefully in order not to adversely affect the properties of the formulation. It is important that the first phase should constitute the major part of the formulation and the second phase constitute a minor part. From FIG. 1 it can be seen that the percent excess of material, e.g. metal oxide, can determine the amount of the second portion.

When the electrode formulation is comprised of first and second phases, as explained above, it is important that the metal oxide provided to constitute the minor portion be selected carefully. It has been found that better results can be obtained when the second phase has a lattice structure compatible with the first phase.

With respect to the composition having the formulae referred to above, $M_i$ should be at least a metal selected from the group consisting of Ni, Sn, Zr, Zn, Co, Mn, Ti, Nb, Ta, Li, Fe and Hf. M may also be a metal selected from this list. When $M_i$ includes Ni and a tetravalent metal such as Sn, Ti or Zr, then $m \geqq 3$. $M_j$ should be at least a metal selected from the group consisting of Fe, V, Cr, Mn, Al, Nb, Ta, Zr, Sn, Zn, Co, Ni, Hf and Y and M' may also be a metal selected from this list. Preferably, the composition is formulated from at least two metal oxides of these metals. A preferred composition is formulated from NiO and $Fe_2O_3$. A typical composition using NiO and $Fe_2O_3$ is $Ni(Fe_{y=0.7}Ni_{y'=0.3})_2O_4$ or $Ni_{1.6}Fe_{1.4}O_4$. In the NiO and $Fe_2O_3$ system, y can range from 0.2 to 0.95 and y' from 0.05 to 0.80. Other compositions which may be formulated in accordance with the present invention include $Co(Fe_{y=0.6}Co_{y'=0.4})_2O_4$ where the starting components are $Co_3O_4$ and $Fe_2O_3$. In the $Co_3O_4$ and $Fe_2O_3$ system, y also can range from 0.4 to 0.95 and y' from 0.05 to 0.80. In addition to the above, a three component system may be used depending to some extent on characteristics desired in the final composition. For example, $Fe_2O_3$, NiO and $Co_3O_4$ may be combined in accordance with the invention. Also, $Fe_2O_3$, $SnO_2$ and $Co_3O_4$ may be combined to provide a useful composition. From the above, it will be understood that other combinations can be made which are within the purview of the invention.

With respect to electrodes made from composition in accordance with the invention, it should be understood that there can be varying degrees of inertness. That is, inertness in one respect can be defined with respect to metal being produced. For example, even if an electrode does not appreciably change its physical dimensions, it still can be considered to be lacking appropriate inertness if the metal produced contains an unreasonable amount of impurities. In the case of aluminum, commercial grade contains about 99.5 wt.% aluminum, the remainder impurities. Accordingly, an inert electrode, as defined with respect to aluminum, is one capable of producing 99.5 wt.%, the remainder impurities.

Ceramic fabrication procedures well known to those skilled in the art can be used to fabricate electrodes in accordance with the present invention.

The electrode composition of the present invention is particularly suited for use as an anode in an aluminum producing cell. In one preferred aspect, the composition is particularly useful as an anode for a Hall cell in the production of aluminum. That is, when the anode is used it has been found to have very high resistance to bath used in a Hall cell. For example, the electrode composition has been found to be resistant to attack by cryolite ($Na_3AlF_6$) type electrolyte baths where operated at temperatures around 970° C. Typically, such baths have weight ratio of NaF to $AlF_3$ in a range of about 1.1:1 to 1.3:1. Also, the electrode has been found to have outstanding resistance to lower temper cryolite type baths where $NaF/AlF_3$ ratio can be in the range from 0.5 up to 1.1:1. These baths may be operated typically at temperatures of about 800° to 850° C. While such a bath may consist only of $Al_2O_3$, NaF and $AlF_3$, it is possible to provide in the bath at least one halide compound of the alkali and alkaline earth metals other than sodium in an amount effective for reducing the operating temperature. Suitable alkali and alkaline earth metal halides are LiF, $CaF_2$ and $MgF_2$. In one embodiment, the bath can contain LiF in an amount between 1 and 15%.

Figure 2:
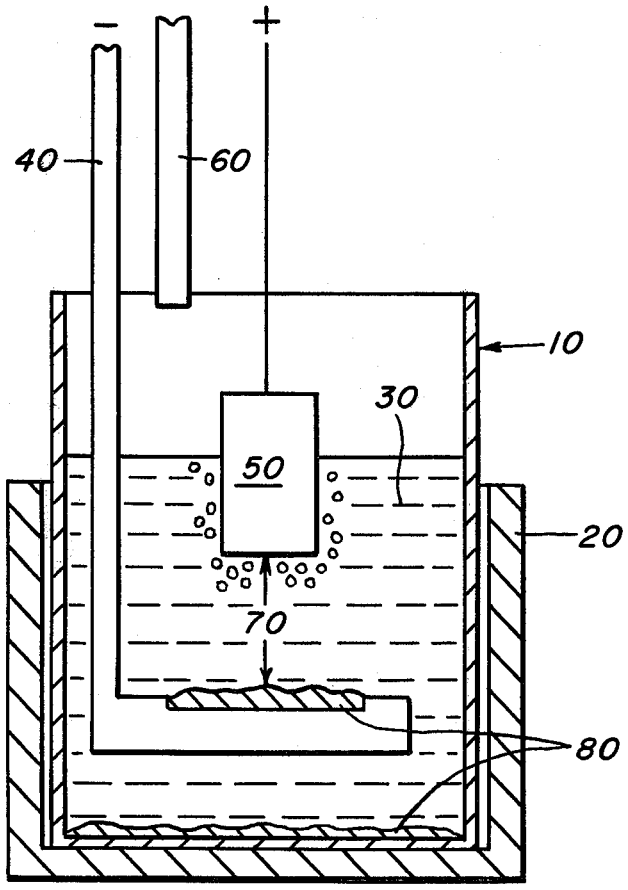
FIG. 2 is a schematic representation of an electrolytic cell showing the inert electrode of the invention being tested.

A cell of the type in which anodes having compositions in accordance with the invention were tested, is shown in FIG. 2. In FIG. 2, there is shown an alumina crucible 10 inside a protection crucible 20. Bath 30 is provided in the alumina crucible and a cathode 40 is provided in the bath. An anode 50 having an inert electrode also in the bath is shown. Means 60 is shown for feeding alumina to the bath. The anode-cathode distance 70 is shown. Metal 80 produced during a run is represented on the cathode and on the bottom of the cell.

In certain instances it may be desirable to use a ceramic composition of the present invention as a cladding. That is, in bipolar application, for example, the electrode of the invention may be a composite with the cathodic side fabricated from carbon or titanium diboride or the like and separated from the anodic side (which is fabricated from ceramic composition of the present invention) by a higher conducting metal such as nickel, nickel-iron alloys, nickel-chromium alloys or stainless steels. When such arrangement is used, then it can be desirable to protect the ends of such composite electrode with an inert nonconducting material such as silicon nitride, silicon oxynitride, boron nitride, silicon aluminum oxynitride and the like. It will be appreciated that intermediate layers of other metals or materials such as copper, platinum, indium, cobalt, molybdenum, or carbides, nitrides, borides and silicides may be used in the composite electrode.

Also, in electrolytic cells, such as Hall cells, claddings of the composition of the invention may be provided on highly conductive members which may then be used as anode. For example, a composition as defined by the formulas referred to hereinabove may be sprayed, e.g. plasma sprayed, onto the conductive member to provide a coating or cladding thereon. This approach can have the advantage of lowering or reducing the length of the resistance path between the highly conductive member and molten salt electrolyte and thereby significantly lowering the overall resistance of the cell. Highly conductive members which may be used in this application can include metals such as stainless steels, nickel, iron-nickel alloys, copper, and the like whose resistance to attack by molten salt electrolyte might be considered inadequate yet whose conductive properties can be considered highly desirable. Other highly conductive members to which the composition of the invention can be applied include, in general, sintered composition of refractory hard metals including carbon and graphite.

The thickness of the coating applied to the conductive member should be sufficient to protect the member from attack and yet maintained thin enough to avoid unduly high resistances when electrical current is passed therethrough. Conductivity of the coating should be at least 0.01 $ohm^{-1}cm^{-1}$.

In another embodiment of the subject invention, it has been discovered that the conductivity of the electrode composition as defined hereinabove can be increased significantly by providing in or dispersing therethrough at least one metal selected from the group consisting of Co, Fe, Ni, Cu, Pt, Rh, In and Ir or alloys thereof. When the metal is provided in the electrode composition, the amount should not constitute more than 30 vol.% metal, with the remainder being the composition. In a preferred embodiment, the metal provided in the composition can range from about 0.1 to 25 vol.%, with suitable amounts being in the range of 1 to about 20 vol.%.

When the electrode composition is formulated from NiO and $Fe_2O_3$, a highly suitable metal for dispersing through the composition is nickel. In the NiO and $Fe_2O_3$ system, nickel can be present in the range of about 5 to 30 wt.%, with a preferred amount being in the range of 5 to 15 wt.%. It has been found that the addition of nickel to this can increase the conductivity of the composition as much as 30 times.

Metals which may be added to the electrode composition should have beneficial results in conductivity and yet should not affect the composition adversely with respect to resistance to molten salts or bath. Such metals which have these characteristics are those which are normally not preferentially oxidized with respect to the electrode composition or ceramic at operating temperatures.

It should be noted that in order to optimize the conductivity of the metal provided in the electrode composition, it is important to minimize the amount of oxide that is permitted to form on the metal during fabrication. That is, it has been discovered that during formulation of the electrode composition and metal composite, there is a tendency for the metal to oxidize. This can interfere with conductivity and is best avoided. The tendency to oxidize has been observed for instance in the NiO and $Fe_2O_3$ system when nickel was being added.

For purposes of combining the electrode composition and metal, one suitable method includes grinding of the electrode composition, for example, resulting from the NiO and $Fe_2O_3$ combination, to a particle size in the range of 25 to 400 mesh (Tyler Series) and providing the metal in a particle size in the range of 100 to 400 mesh (Tyler Series), e.g. powdered nickel or copper, for example. Before combining, it has been discovered that the powdered metal should be treated with a binder such as carbowax. This treatment should be such that particles of the powdered nickel are substantially coated with a wax layer. Upon mixing, the ground electrode composition adheres to the carbowax providing a layer around the metal particles which is believed to prevent the metal particle from oxidizing during fabrication steps such as sintering. Typically, the electrode composition and powdered metal or metal compound to be added are mixed together, pressed at about 40,000 psi and sintered at about 1300° C.

While copper has been noted hereinabove as being useful for greatly increasing the conductivity of electrode compositions, it has been discovered that copper has great utility in compositions for inert electrodes, such as those of the invention, as a sintering aid. That is, copper has been found to both greatly increase conductivity and to increase the density of electrode composition of the subject invention. The use of powdered copper having a particle size not greater than −10 mesh (Tyler Series) and preferably not greater than −100 mesh (Tyler Series) can increase the density of an inert electrode composition substantially. For example, the density of the electrode composition shown in FIG. 3 was increased from 4.6 grams/cc to 5.25 grams/cc, an increase in density of 14%.

In addition to the substantial increase in density, it has been discovered that the use of powdered copper in inert electrode compositions has the effect of removing substantially all of the voids therefrom. That is, the use of powdered copper in inert electrode compositions results in such composition being substantially void-free. Eliminating voids or providing a substantially void-free inert electrode is important in that it can have the benefit of greatly increasing the electrode's ability to withstand the highly corrosive environments in electrolytic cells. This result is obtained by substantially eliminating sites or voids to which bath, e.g. electrolyte with metal oxide dissolved therein, can migrate. The extent of elimination of voids can be seen by a comparison of FIG. 3 (referred to earlier) and FIG. 4 in which copper is shown as a separate white-colored phase. The electrode composition shown (at 400×) in FIG. 4 was made or fabricated from the same materials and with substantially the same procedures as that in FIG. 3 except powdered copper was added having a particle size of −100 mesh (Tyler Series). Powdered copper was added in an amount which constitutes 5 wt.% of the composition shown in FIG. 4. Powdered copper can constitute as much as 30 wt.% of an electrode composition; however, preferably the copper content should be in the range of 0.5 to 20 wt%. It should be noted that $Bi_2O_3$ and $V_2O_5$ may also be used to increase the density of inert electrode compositions in the same manner as copper, but on a less preferred basis since neither of these compounds significantly improve conductivity. Likewise, the addition of nickel as noted hereinabove may be used but on a less preferred basis since nickel does not appear to significantly aid densification. Of course, it will be understood that combinations of nickel, copper, $Bi_2O_3$ and $V_2O_5$ may be used to provide densified inert electrode compositions having high levels of conductivity and being substantially free of voids.

The following examples are still further illustrative of the invention.

EXAMPLE 1

$Fe_2O_3$ having a particle size of −100 mesh (Tyler Series) was first heated for purposes of removing moisture. Thereafter, 58 grams of the dried $Fe_2O_3$ were mixed with 62 grams of NiO also having a particle size of −100 mesh (Tyler Series). The mixing was carried out for about one-half hour. After mixing, the combination of oxides was pressed in a mold at room temperature at a pressure of 25,000 psi to produce a bar-shaped electrode having a density of about 4.0 grams/cc. The bar was sintered in air at a temperature of 1125° C. for 16 hours. The sintered bar was then crushed or ground to a particle size of −100 mesh and again pressed at 25,000 psi and sintered at 1400° C. to provide a bar-shaped electrode having a density of about 4.6 grams/cc.

The electrode was tested as an anode in an electrolytic cell, as shown in FIG. 2. The cell contained a bath comprising 90 wt.% $NaF/AlF_3$ in a 1.1 ratio, 5 wt.% $Al_2O_3$ and 5 wt.% $CaF_2$ maintained at 960° C. The anode-cathode distance in the cell was 1½ inch and a platinum wire was used for purposes of connecting the anode to an electrical source. Voltage in the cell was about 5 volts and current density was 6.5 amps/in$^2$. The cell was run for 24 hours and aluminum was collected on the carbon cathode. On analyzing, the aluminum contained 0.03 wt.% Fe and 0.01 wt.% Ni. At 950° C., the conductivity of the anode was about 0.4 (ohm-cm)$^{-1}$.

EXAMPLE 2

In this example, the anode was fabricated and tested as in Example 1, except that after $NiO/Fe_2O_3$ was first sintered and ground, to the mixture (having 51.7 wt.% NiO and 48.3 wt.% $Fe_2O_3$) was added 10% nickel powder having a particle size of −100 mesh (Tyler Series). However, prior to mixing with the $NiO/Fe_2O_3$ mixture, the nickel powder was first treated with carbowax to provide a coating thereof on the nickel particles, the wax being provided for purposes of ensuring that a coating of the $NiO/Fe_2O_3$ mixture adhered to the nickel particles. The combination was pressed and sintered as in Example 1 except the sintering and conductivity measurements took place in an argon atmosphere. The cell was run for 17 hours and aluminum collected on the cathode was analyzed and found to contain 0.15 wt.% Fe and 0.15 wt.% Ni. At 950° C., the conductivity of the anode was about 4 $(ohm\text{-}cm)^{-1}$ which is about a ten-fold increase over the electrode in Example 1.

EXAMPLE 3

In this example, the anode was fabricated and treated as in Example 1 except the anode contained 29.73 wt.% NiO, 31.78 wt.% $Fe_2O_3$ and 38.49 wt.% $NiF_2$. This composition was mixed, calcined at 800° C., screened, pressed at 25,000 psi, sintered at 1100° C. for 20 hours, crushed to below 100 mesh, pressed at 25,000 psi and sintered at 1300° C. for 16 hours. The density of the sample was 5.3 grams/cc and electrical conductivity was 0.03 $ohm^{-1}cm^{-1}$ at 960° C. The electrode was tested for 26 hours as anode in an electrolytic cell. On analyzing (Ni+Fe) impurities in aluminum metal produced during the test, it was found that Ni and Fe combined were only 0.2 wt.%.

EXAMPLE 4

In this example a calcined mixture of 51.7 wt.% NiO and 48.3 wt.% $Fe_2O_3$ was plasma-sprayed on 446 stainless steel substrate to provide an oxide coating thickness of 380 μm. The stainless steel substrate was cylindrical shaped and was provided with a hemispherical bottom portion to avoid sharp edges in order to facilitate coating. An anode connection was made by tapping threads into the stainless steel and screwing in an Ni 200 threaded rod into the substrate. The assembled anode was tested as in Example 1 and the run duration was 11 hours. The metal produced contained less than 0.03 wt.% Ni and approximately 0.05 wt.% Fe and the substrate was not attacked by the bath.

EXAMPLE 5

Figure 4:
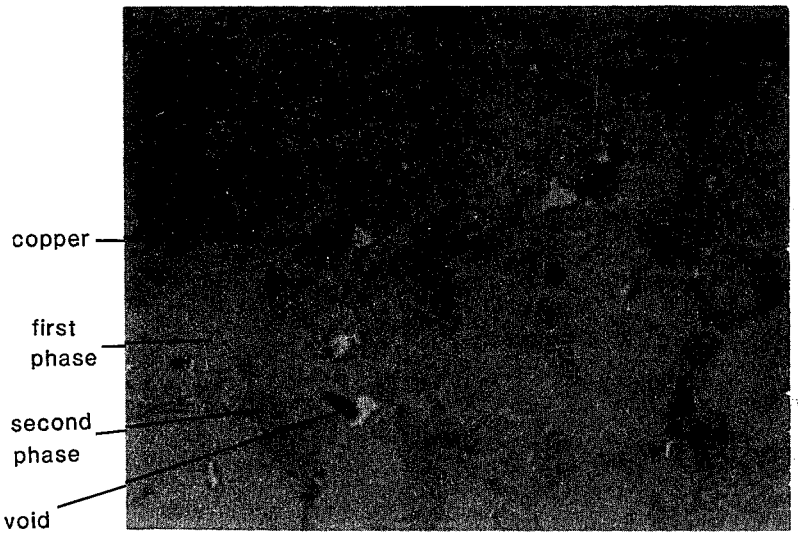
FIG. 4 is another micrograph showing powdered copper dispersed in the electrode composition in accordance with the invention.

In this example, the anode was fabricated as in Example 2 except that 10 wt.% copper powder was added to the mixture containing 51.7 wt.% NiO and 48.3 wt.% $Fe_2O_3$. The combination was pressed and sintered as in Example 2. The addition of copper into this composition increased its conductivity by about eight-fold. The anode was examined and found to contain three phases, as shown in FIG. 4. That is, metallic copper was found to exist as a separate phase. The copper-containing material was run for 23 hours and examination showed that no significant corrosion had occurred and copper in the aluminum produced amounted to approximately 0.27 wt.%. The same anode was run again with a fresh bath for another 25 hours. The copper in aluminum produced amounted to 0.18 wt.%. The same anode was run for a third time in a new bath for 12 hours and the aluminum produced contained approximately 0.18 wt.% Fe, 0.012 wt.% Cu and 0.027 wt.% Ni. This result shows that after some conditioning, corrosion or attack of the anode is very small. Further, the analysis demonstrates that an anode of this composition has the capability of producing commercial grade aluminum (99.5 wt.% Al).

While the invention has been described in terms of preferred embodiments, the claims appended hereto are intended to encompass other embodiments which fall within the spirit of the invention.

Having thus described the invention and certain embodiments thereof, what is claimed is:

1. A composition suitable for fabricating into an inert electrode for use in the electrolytic production of metal from a metal compound dissolved in a molten salt, the composition comprising:

(a) a combination metal compound defined by the formula:

$$\left\{\sum_{i=1}^{m}(M_i)F_{Mi}\right\}\left\{\sum_{j=1}^{p}(M_j)F'_{Mj}\sum_{i=1}^{m}(M_i)F'_{Mi}\right\}_Z\left(\sum_{r=1}^{n}X_rF_{xr}\right)_K$$

where $$\sum_{i=1}^{m}F_{Mi}=1;\ \sum_{j=1}^{p}F'_{Mj}+\sum_{i=1}^{m}F'_{Mi}=1 \text{ and } \sum_{r=1}^{n}X_rF_{xr}=1;$$

z is a number in the range of 1.0 to 2.2; K is a number in the range of 2.0 to 4.4; $M_i$ is at least one metal having a valence of 1, 2, 3, 4 or 5 and is the same metal or metals when $M_i$ is used in the composition; $M_j$ is a metal having a valence of 2, 3 or 4, $M_i$ and $M_j$ being different metals; $X_r$ is at least one of the elements from the group consisting of O, F, N, S, C and B; m, p and n are the number components which comprise $M_i$, $M_j$ and $X_r$; $F_{Mi}$, $F'_{Mj}$, $F'_{Mi}$ or $F_{xr}$ are the mole fractions of $M_i$, $M_j$ and $X_r$ and $0<F'_{Mi}<1$; and (b) at least one metal powder dispersed through the combination metal compound for purposes of increasing its conductivity, the metal powder selected from the group consisting of Ni, Co, Fe, Cu, Pt, Rh, In and Ir and alloys thereof, the metal powder provided in a particle size of not greater than −10 mesh (Tyler Series) for dispersing in the combination metal compound and constituting up to about 30 vol.% of the composition.

2. The electrode composition in accordance with claim 1 wherein the metal powder is in the range of 0.1 to 25 vol.%.

3. The electrode composition in accordance with claim 1 wherein the metal powder dispersed in the ceramic oxide composition has a particle size not greater than −100 mesh (Tyler Series).

4. The electrode composition in accordance with claim 1 wherein the metal powder is at least one of the group consisting of Ni and Cu.

5. A composition suitable for fabricating into an inert electrode for use in the electrolytic production of metal from a metal compound dissolved in a molten salt, the electrode comprising:

(a) a combination metal compound defined by the formula:

$$\left\{\sum_{i=1}^{m}(M_i)F_{Mi}\right\}\left\{\sum_{j=1}^{p}(M_j)F'_{Mj}\sum_{i=1}^{m}(M_i)F'_{Mi}\right\}_Z\left(\sum_{r=1}^{n}X_rF_{xr}\right)_K$$

where $$\sum_{i=1}^{m}F_{Mi}=1;\ \sum_{j=1}^{p}F'_{Mj}+\sum_{i=1}^{m}F'_{Mi}=1 \text{ and } \sum_{r=1}^{n}X_rF_{xr}=1;$$

z is a number in the range of 1.0 to 2.2; K is a number in the range of 2.0 to 4.4; $M_i$ is at least one metal having a valence of 1, 2, 3, 4 or 5 and is the same metal or metals when $M_i$ is used in the composition; $M_j$ is a metal having a valence of 2, 3 or 4, $M_i$ and $M_j$ being different metals; $X_r$ is at least one of the elements from the group consisting of O, F, N, S, C and B; m, p and n are the number components which comprise $M_i$, $M_j$ and $X_r$; $F_{Mi}$, $F'_{Mj}$, $F'_{Mi}$ or $F_{xr}$ are the mole fractions of $M_i$, $M_j$ and $X_r$ and $0<F'_{Mi}<1$; and (b) at least one metal powder dispersed through the combination metal compound for purposes of increasing its conductivity, the metal powder selected from the group consisting of Ni, Cu and Fe and alloys thereof, and provided in a particle size of not greater than −10 mesh (Tyler Series) for dispersing in the combination metal compound and constituting 0.1 to 25 vol.% of the inert electrode composition.

6. A composition suitable for fabricating into an inert electrode for use in the electrolytic production of metal from metal compound dissolved in a molten salt, the electrode comprising:

(a) at least two metal compounds combined to provide a combination metal compound consisting essentially of a composition defined by the formula $M(M'_yM_{1-y})_zX_K$ where y is a number less than one and greater than 0 and M is a metal having a valence selected from the group consisting of 1, 2, 3, 4 and 5 and M' is a metal having a valence selected from the group consisting of 2, 3, 4 and 5, M and M' being different metals, z is a number selected from the group consisting of 2, 3 and 4, X is at least one material selected from the group consisting of O, F, N, S, C and B and K is a number in the range of 2 to 4.4, the electrode being highly conductive and being inert with respect to said molten salt; and (b) at least one metal powder dispersed through the combination metal compound for purposes of increasing its conductivity, the metal powder selected from the group consisting of Ni, Co, Fe, Cu, Pt, Rh, In and Ir, and alloys thereof, the metal powder provided in a particle size of not greater than −10 mesh (Tyler Series) for dispersing in the combination metal compound and constituting up to about 20 vol.% of the composition.

7. The composition in accordance with claim 6 wherein X is oxygen.

* * * * *

UNITED STATES PATENT AND TRADEMARK OFFICE

CERTIFICATE OF CORRECTION

PATENT NO. : 4,374,761

DATED : February 22, 1983

INVENTOR(S) : Siba P. Ray

It is certified that error appears in the above—identified patent and that said Letters Patent is hereby corrected as shown below:

| | |
|---|---|
| Col. 2, line 62 | Change "F" (second and third occurrence) to --F'--. |
| Col. 2, line 66 | Same change. |
| Col. 12, line 14 (claim 1) | Same change. |
| Col. 12, line 59 (claim 5) | Same change. |

Signed and Sealed this

*Third* Day of *May 1983*

[SEAL]

*Attest:*

GERALD J. MOSSINGHOFF

*Attesting Officer*

*Commissioner of Patents and Trademarks*